US008266941B1

(12) United States Patent
Hufnagl et al.

(10) Patent No.: US 8,266,941 B1
(45) Date of Patent: Sep. 18, 2012

(54) FASTENER INSTALLATION TOOL

(75) Inventors: Gerhart Hufnagl, Tucson, AZ (US); Randy Torrence, Tucson, AZ (US); Rodrigo Pinheiro, Riverside, CA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/315,571

(22) Filed: Dec. 9, 2011

(51) Int. Cl.
*B21D 31/00* (2006.01)

(52) U.S. Cl. ..... 72/391.8; 29/243.526; 29/243.53; 81/356; 72/114

(58) Field of Classification Search ..... 29/243.526, 29/243.527, 243.53, 243.54, 524.1; 72/114, 72/391.2–391.8; 81/356
See application file for complete search history.

(56) References Cited

U.S. PATENT DOCUMENTS 4,425,782 A * 1/1984 Todisco ..... 72/391.8
4,520,648 A * 6/1985 Gregory ..... 29/243.53
4,653,308 A * 3/1987 Gregory ..... 29/243.527
5,771,738 A * 6/1998 Ko ..... 72/391.8

OTHER PUBLICATIONS

Huck Aerospace Fastening Systems, Tooling Product Catalog, Jan. 2010 (116 pages)

* cited by examiner

*Primary Examiner* — David B Jones
(74) *Attorney, Agent, or Firm* — Greenberg Traurig, LLP

(57) ABSTRACT

A fastener installation tool including an upper jaw having a head adapted to engage a fastener for securing a plurality of workpieces to one another, a lower jaw, and first and second pairs of links fastened to the upper and lower jaws. The tool includes a hydraulic cylinder having one end attached to the lower jaw and a piston rod attached to the first pair of links. The cylinder actuates the tool between a disengaged position, in which the links are in a retracted position and the upper jaw and the lower jaw are juxtaposed with one another, and an engaged position, in which the links are in an extended position and the upper jaw and the lower jaw are spaced apart from one another. The tool is adapted to install the fastener to the workpieces when the tool is in its engaged position.

19 Claims, 19 Drawing Sheets

FASTENER INSTALLATION TOOL

FIELD OF THE INVENTION

The present invention relates to fastener installation tools and, more particularly, to hydraulic pull-in and swaging fastener installation tools for installing interference fit fasteners in limited accessible areas.

BACKGROUND OF THE INVENTION

Interference fit fasteners are driven into composite structures by pneumatic rivet guns or pneudraulic "pull-in" tools. In limited access areas, offset pull-in tools are used. Driving fasteners with rivet guns risks damage to the surface of the composite structure, traditional pull-in tools are limited in use within limited access areas, and traditional offset pull-in tools have limited offset distance capability.

SUMMARY OF THE INVENTION

In an embodiment, a fastener installation tool includes an upper jaw having a first end, a second end opposite the first end, a first side extending between the first and second ends, a second side opposite the first side and extending between the first and second ends, and a head located at the first end and adapted to engage a fastener for securing a plurality of workpieces to one another; a lower jaw having a first end, a second end opposite the first end of the lower jaw, a first side extending between the first and second ends of the lower jaw, a second side opposite the first side of the lower jaw and extending between the first and second ends of the lower jaw, and a head located at the first end of the lower jaw; a first pair of links, each of which includes a first end, a second end opposite the first end thereof, and an intermediate point located between the first and second ends thereof, the first end of one of the first pair of links being fastened to the first end of the lower jaw on the first side thereof, and the intermediate point of the one of the first pair of links being fastened to the second end of the upper jaw on the first side thereof, the first end of the other of the first pair of links being fastened to the first end of the lower jaw on the second side thereof, and the intermediate point of the other of the first pair of links being fastened to the second end of the upper jaw on the second side thereof; a second pair of links, each of which includes a first end and a second end opposite the first end thereof, the first end of one of the second pair of links being fastened to the first end of the upper jaw on the first side thereof and the second end of the one of the second pair of links being fastened to the lower jaw on the first side thereof, the first end of the other of the second pair of links being fastened to the first end of the upper jaw on the second side thereof, and the second end of the other of the second pair of links being fastened to the lower jaw on the second side thereof; and actuating means, attached to the second end of the lower jaw and the second ends of the first pair of links, for actuating the fastener installation tool between a disengaged position, in which the first pair of links and the second pair of links are each in a retracted position and the upper jaw and the lower jaw are juxtaposed with one another, and an engaged position, in which the first pair of links and the second pair of links are each in an extended position and the upper jaw and the lower jaw are spaced apart from one another, the head of the upper jaw being adapted to install the fastener to the plurality of workpieces when the fastener installation tool is in its engaged position.

In an embodiment, the actuating means includes a hydraulic cylinder having a first end, a second end opposite the first end of the cylinder, and a piston rod extending from the second end of the cylinder, the first end of the cylinder being fastened to the second end of the lower jaw, and one end of the piston rod being fastened to the second ends of the first pair of links, the piston rod being movable between a retracted position when the fastener installation tool is in its disengaged position, and an extended position when the fastener installation tool is in its engaged position.

In an embodiment, the head of the upper jaw includes a collet having an interior portion and a set of gripping jaws housed within the interior portion, the set of gripping jaws including a plurality of internal threads, and wherein the fastener includes a pin member having a pull portion with a plurality of pull grooves, the plurality of internal threads of the set of gripping jaws being sized and shaped to engage the pull grooves of the pin member. In an embodiment, the collet is adapted to provide an axial force on and install the pin member to the plurality of workpieces when the fastener installation tool is actuated from its disengaged position to its engaged position.

In an embodiment, the fastener includes a sleeve member installed within the plurality of workpieces, and the pin member is sized and shaped to be installed within and form an interference fit with the sleeve member. In an embodiment, the head of the lower jaw includes an anvil member, and wherein the fastener includes a swaging collar, and when the pin member of the fastener includes a threaded portion, the swaging collar being adapted to be swaged onto the threaded portion of the pin member by the anvil member when the fastener installation tool is actuated from its disengaged position to its engaged position. In an embodiment, the collet of the upper jaw is adapted to shear the pull portion from the pin member when the fastener installation tool is actuated from its disengaged position to its engaged position. In an embodiment, the head of the upper jaw includes an interior portion and a cap removably attached to the head to allow access to the interior portion.

In an embodiment, each of the first pair of links includes a linear-shaped first portion extending from the first end to the intermediate point, and an angular-shaped second portion extending from the intermediate point to the second end. In an embodiment, the first and second pairs of links are fastened rotatably to the upper and lower jaws by a plurality of fasteners. In an embodiment, the first end of the cylinder is fastened rotatably to the lower jaw by a fastener.

In an embodiment, the second end of the one of the second pair of links is fastened to the lower jaw intermediate the first and second ends of the lower jaw, and the second end of the other of the second pair of links is fastened to the lower jaw intermediate the first and second ends of the lower jaw.

DETAILED DESCRIPTION OF THE DRAWINGS

Figure 1:
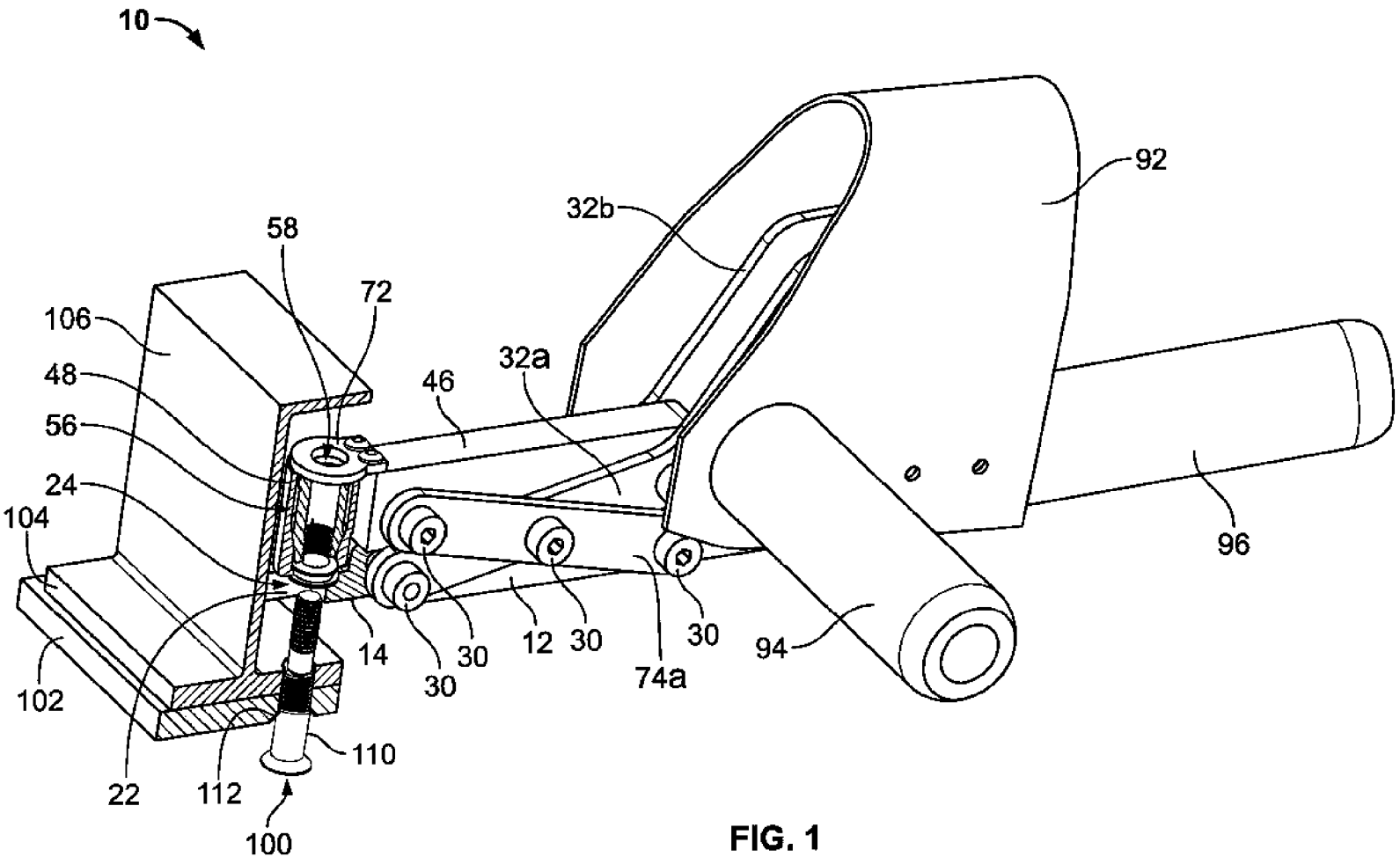
FIG. 1 is a top perspective view of an embodiment of a pull-in fastener installation tool shown in an "engaged" position, portions of the tool being shown in cross-section.
Figure 2A:
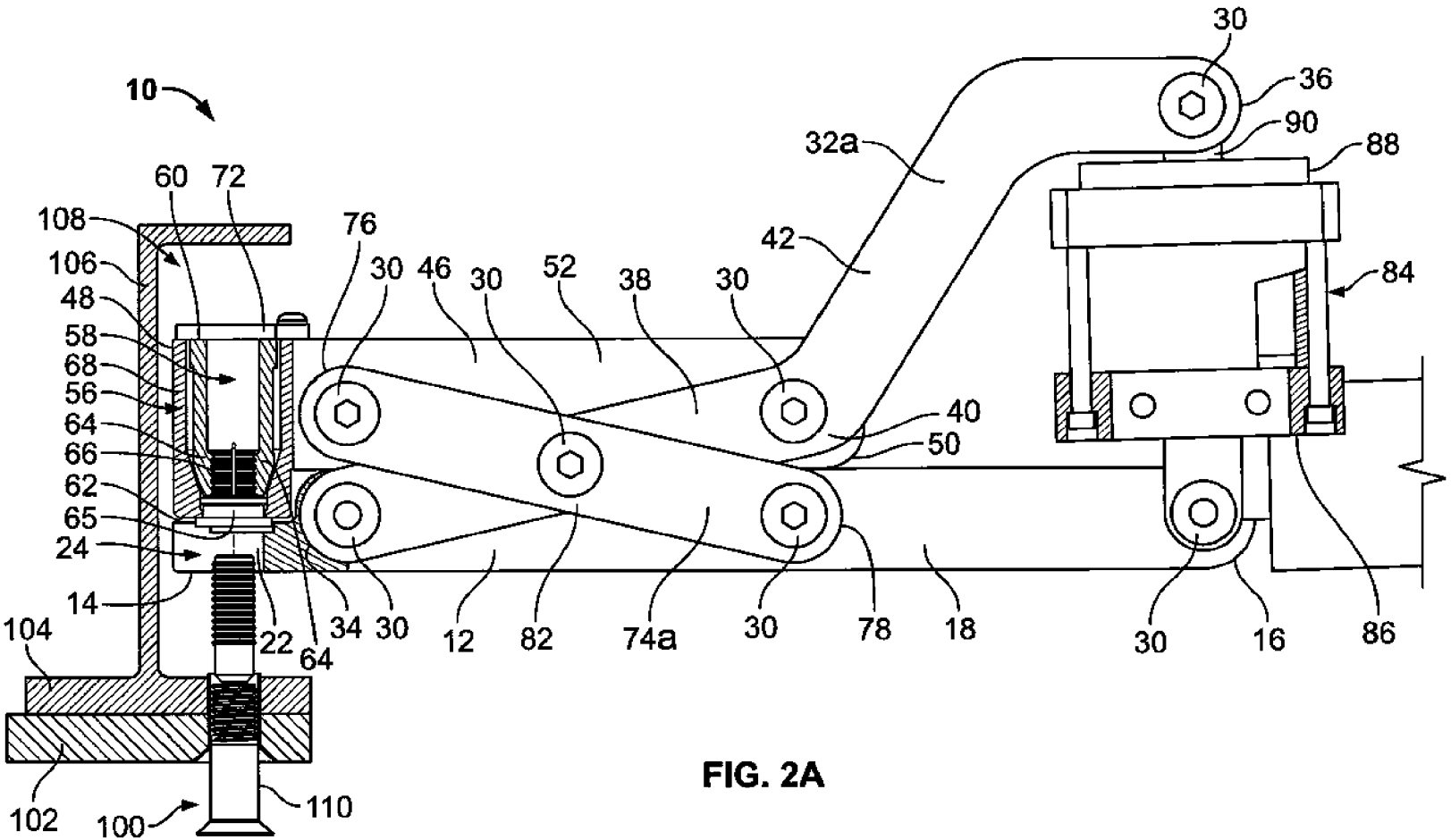
FIG. 2A is a side elevational view of the tool shown in FIG. 1, with a safety shroud employed by the tool having been removed.
Figure 2B:
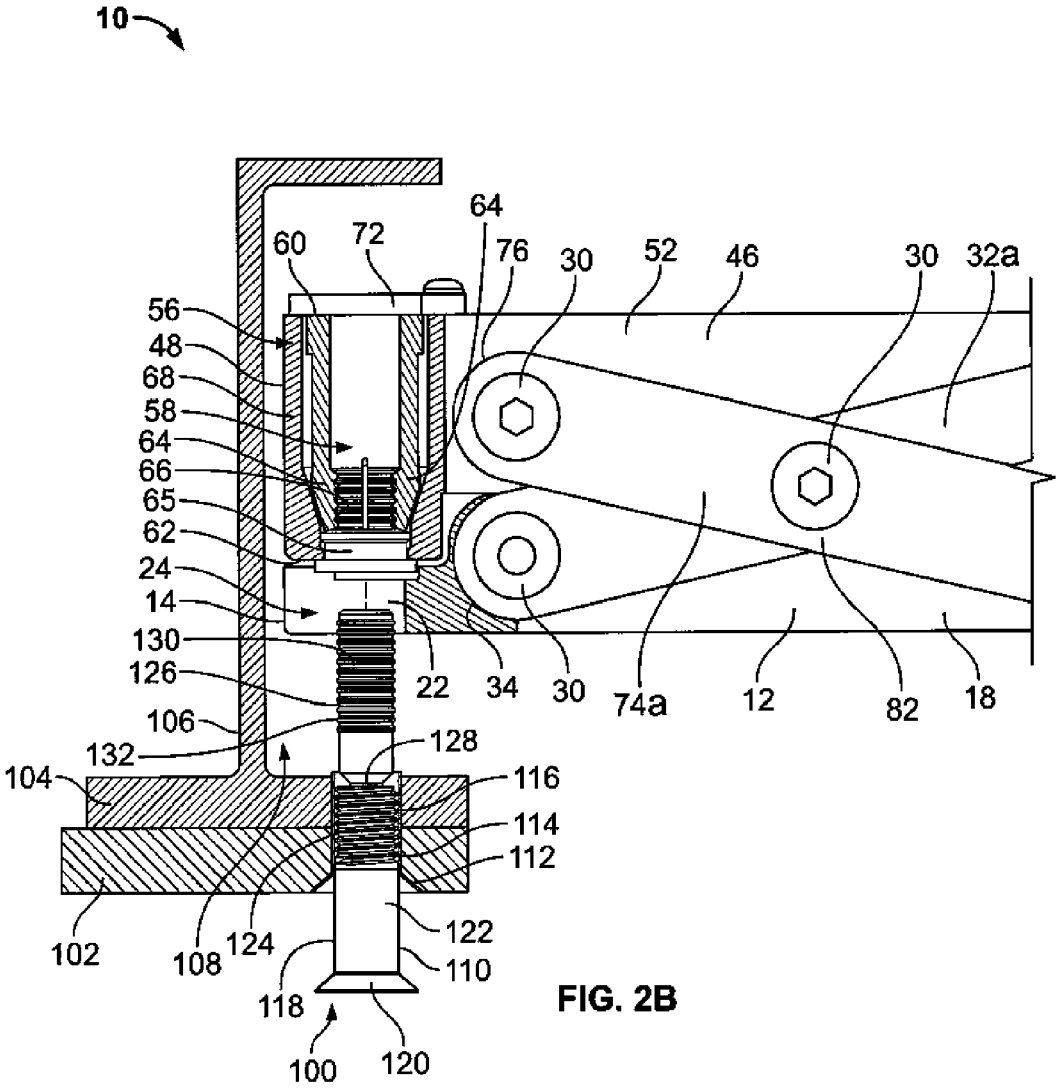
FIG. 2B is a close-up side elevational view of a portion of the tool shown in FIG. 2A.
Figure 2C:
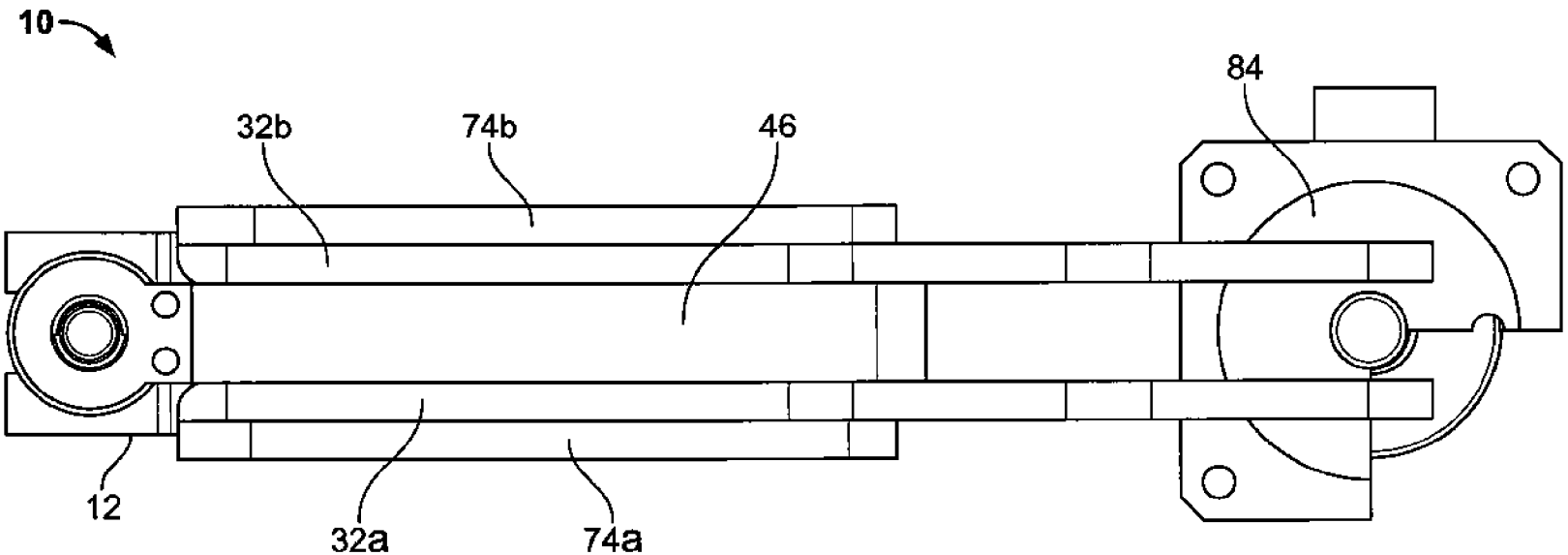
FIG. 2C is a top plan view of the tool shown in FIG. 2A.

Referring to FIGS. 1 through 2B, in an embodiment, a fastener pull-in tool 10 includes an elongated lower jaw 12 having a first end 14 and a second end 16 opposite the first end 14, a first side 18 and a second side 20, each extending between the first and second ends 14, 16, and a head 22 located at the first end 14. In an embodiment, the head 22 includes an opening 24 whose purpose shall be described hereinafter. Referring to FIGS. 2F and 2G, in an embodiment, the lower jaw 12 includes apertures 26, 27, each of which extends from the first side 18 to the second side 20. In an embodiment, one of the apertures 26 is located proximate to the first end 14 of the lower jaw 12, one the apertures 26 is located proximate to the second end 16 of the lower jaw 12, and the apertures 27 is located intermediate the first and second ends 14, 16. Each of the apertures 26, 27 is sized and shaped to receive one of a plurality of fasteners 30, which will be described in further detail hereinafter. In an embodiment, the apertures 26 are circular in shape, while the aperture 27 is oblong in shape. In an embodiment, the lower jaw 12 includes a concave notch 31 formed within an upper surface 33 thereof and intermediate the first and second ends 14, 16. In an embodiment, the lower jaw 12 is made of steel. In other embodiments, the lower jaw 12 is made of other suitable materials known in the art.

Figure 2D:
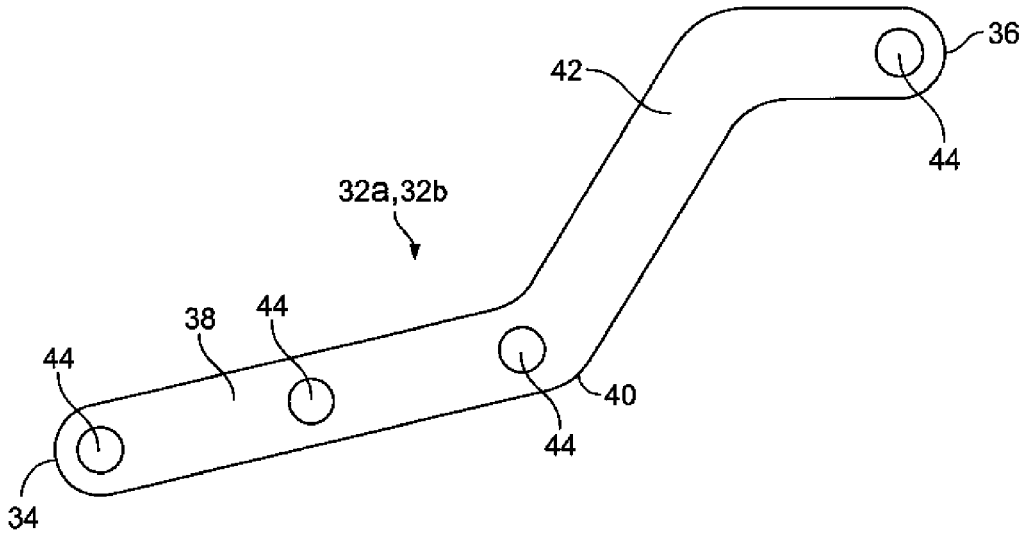
FIGS. 2D and 2E are side elevational views of links employed by the tool shown in FIG. 2A.

With reference to FIGS. 1 through 2D, in an embodiment, the pull-in tool 10 includes a pair of S-shaped links 32*a*, 32*b* that are spaced-apart from and parallel to one another. In an embodiment, each of the links 32*a*, 32*b* includes a first end 34 and a second end 36, a linear-shaped first portion 38 extending from the first end 34 to an intermediate point 40, and an angular-shaped second portion 42 extending from the intermediate point 40 to the second end 36. Each of the links 32*a*, 32*b* includes four apertures 44, one of which is positioned proximate to the first end 34, one of which is positioned proximate to the second end 36, one of which is positioned proximate to the intermediate point 40, and one of which is positioned intermediate the first end 34 and the intermediate point 40 (see FIG. 2D). Each of the apertures 44 is sized and shaped to receive one of the plurality of fasteners 30, which will be described in further detail hereinafter. In an embodiment, the links 32*a*, 32*b* are made of steel. In other embodiments, the links 32*a*, 32*b* are made of other suitable materials known in the art.

Figure 2E:
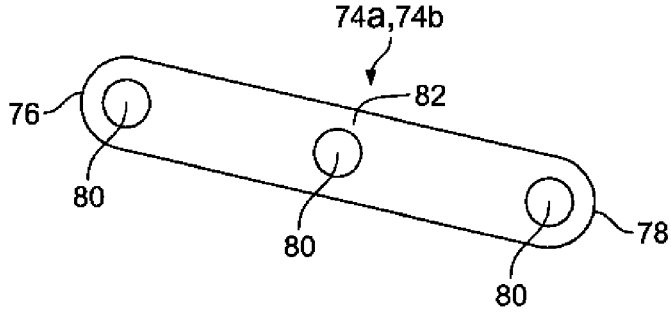
Figure 2F:
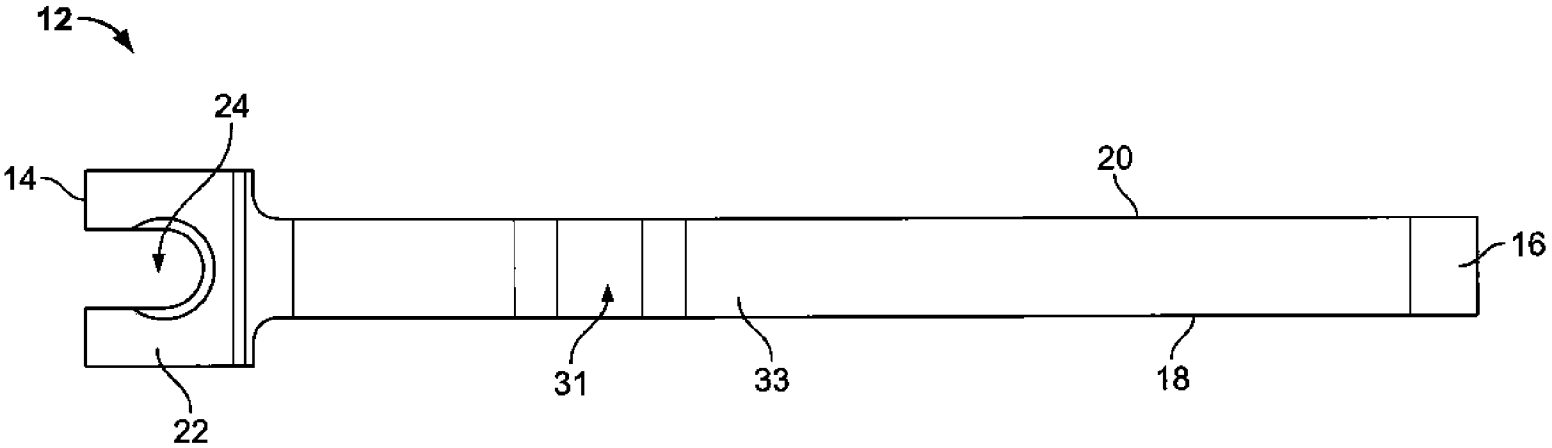
FIGS. 2F and 2G are a top plan view and a side elevational view, respectively, of a lower jaw employed by the tool shown in FIG. 2A.
Figure 2G:
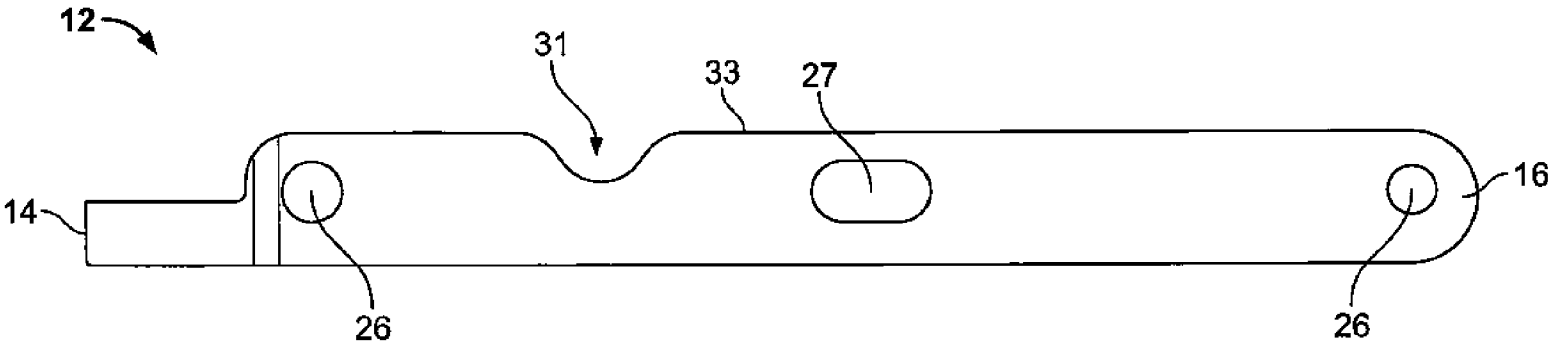
Figure 2H:
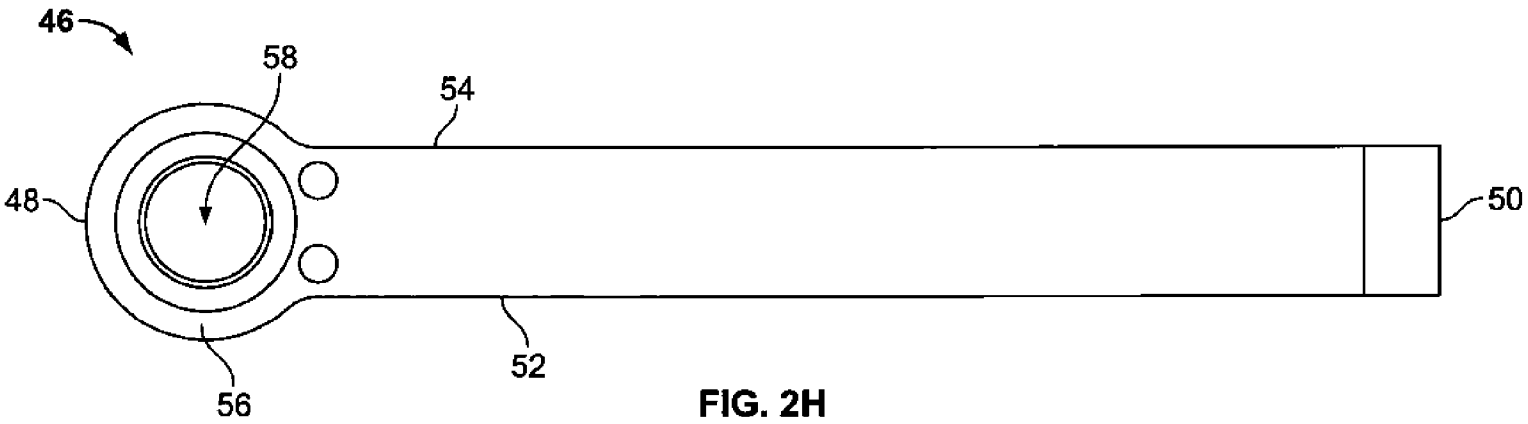
FIGS. 2H and 2I are a top plan view and a sectioned side elevational view, respectively, of an upper jaw employed by the tool shown in FIG. 2A.
Figure 2I:
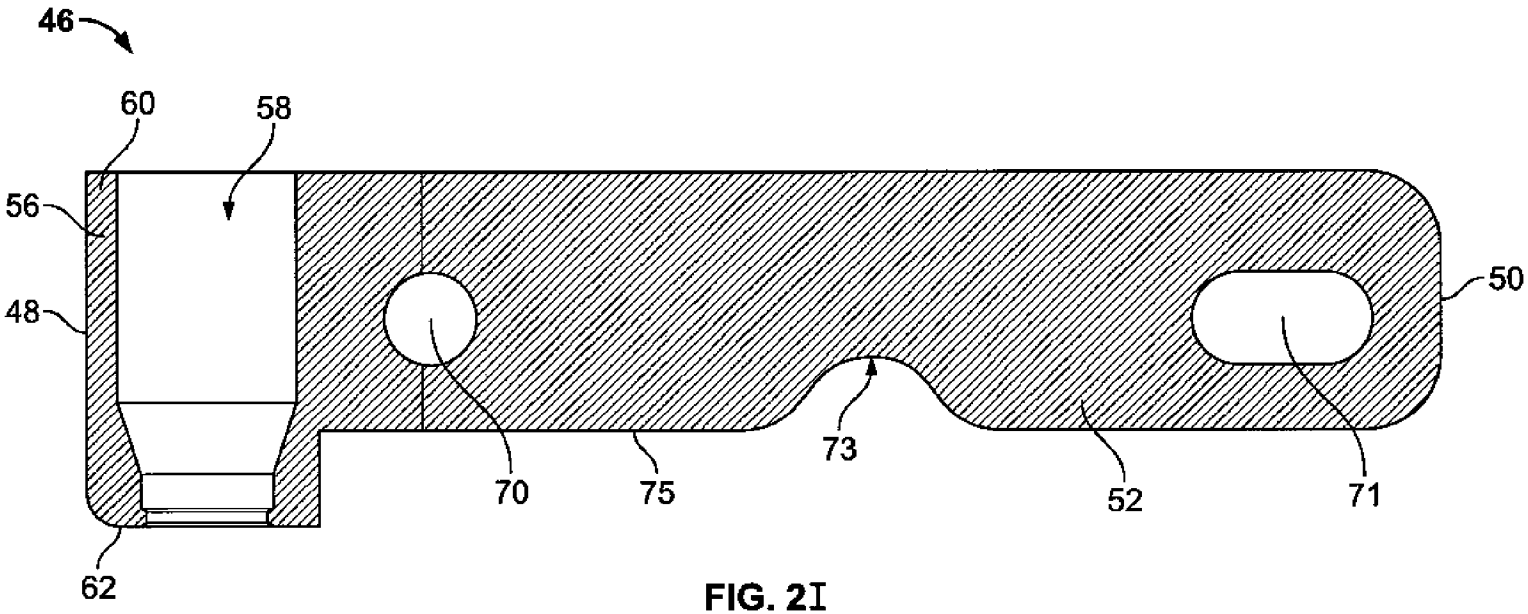

Referring to FIGS. 1 through 2B, 2H and 2I, in an embodiment, the pull-in tool 10 includes an upper jaw 46 having a first end 48 and a second end 50 opposite the first end 48, a first side 52 and a second side 54 extending between the first and second ends 48, 50, and a head 56 located at the first end 48. In an embodiment, the head 56 includes an aperture 58 extending from a top end 60 to a lower end 62. In an embodiment, the head 56 includes a set of gripping jaws 64 with internal threads 66, and a jaw opener 65 that facilitates opening and closing of the gripping jaws 64. In an embodiment, the gripping jaws 64 are located in a tubular collet 68. As shown in FIGS. 2H and 2I, in an embodiment, the upper jaw 46 includes apertures 70, 71, each of which extends from the first side 52 to the second side 54. In an embodiment, the aperture 70 is located proximate to the first end 48, and the aperture 71 is located proximate to the second end 50. Each of the apertures 70 is sized and shaped to receive one of the plurality of fasteners 30, which will be described in further detail hereinafter. In an embodiment, the aperture 70 is circular in shape, while the aperture 71 is oblong in shape. In an embodiment, the upper jaw 46 includes a concave notch 73 formed within a lower surface 75 thereof and intermediate the first and second ends 48, 50. In an embodiment, the upper jaw 46 includes a cap 72 fastened removably to a top end 60 of the head 56. In an embodiment, the cap 72 may be removed to provide access within the collet 68 and to the gripping jaws 64 for the purposes of repair or replacement. In an embodiment, the upper jaw 46 is made from steel. In other embodiments, the upper jaw 46 is made of other suitable materials known in the art.

Referring to FIGS. 1 through 2B and 2E, in an embodiment, the pull-in tool 10 includes a pair of elongated links 74*a*, 74*b*, each of which includes a first end 76 and a second end 78 opposite the first end 76, and three apertures 80, one of which is located proximate to the first end 76, one of which is located proximate to the second end 78, and one of which is located at a point 82 intermediate the first and second ends 76, 78 (see FIG. 2E). Each of the apertures 80 is sized and shaped to receive one of the plurality of fasteners 30, which will be described in further detail hereinafter. In an embodiment, the links 74*a*, 74*b* are made from steel. In other embodiments, the links 74*a*, 74*b* are made of other suitable materials known in the art.

In an embodiment, the first end 34 of the link 32*a* is fastened rotatably to the first end 14 of the lower jaw 12 on the first side 18 thereof with one of the fasteners 30, while the intermediate portion 40 of the link 32*a* is fastened rotatably to the second end 50 of the upper jaw 46 on the first side 52 thereof with one of the fasteners 30. Similarly, in an embodiment, the first end 34 of the link 32*b* is fastened rotatably to the first end 14 of the lower jaw 12 on the second side 20 thereof with one of the fasteners 30, while the intermediate portion 40 of the link 32*b* is fastened rotatably to the second end 50 of the upper jaw 46 on the second side 54 thereof with one of the fasteners 30. In an embodiment, the first end 76 of the link 74*a* is fastened rotatably to the first end 48 of the upper jaw 46 on the first side 52 thereof by one of the fasteners 30, the second end 78 of the link 74*a* is fastened rotatably to the lower jaw 12 on the first side 18 and intermediate the first and second ends 14, 16 thereof by one of the fasteners 30, and the intermediate point 82 of the link 74*a* is fastened rotatably to the intermediate point 40 of the linear-shaped first section 38 of the link 32*a*. Similarly, in an embodiment, the first end 76 of the link 74*b* is attached to the first end 48 of the upper jaw 46 on the second side 54 thereof by one of the fasteners 30, the second end 78 of the link 74*b* is attached to the lower jaw 12 on the second side 20 and intermediate the first and second ends 14, 16 thereof by one of the fasteners 30, and the intermediate point 82 of the link 74*b* is attached to the intermediate point 40 of the linear-shaped first section 38 of the link 32*b*.

Referring to FIG. 2A, in an embodiment, the pull-in tool 10 includes a hydraulic cylinder 84 having a first end 86, a second end 88 opposite the first end 86, and a piston rod 90 extending from the second end 88. In an embodiment, the first end 86 of the cylinder 84 is fastened rotatably to the second end 16 of the lower jaw 12 by a fastener 30, while one end of the piston rod 90 is fastened rotatably to the second ends 36 of the links 32*a*, 32*h* by one of the fasteners 30. In an embodiment, the cylinder 84 includes couplings for connection to a hydraulic power source (not shown in the Figures). In an embodiment, the pull-in tool 10 includes a safety shroud 92 that shields the cylinder 84 and other components of the pull-in tool 10 to protect a user from injury when operating the pull-in tool 10 (see FIG. 1). In an embodiment, the safety shroud 92 is removable to allow access to the cylinder 84 and other components of the pull-in tool 10. In an embodiment, the pull-in tool 10 includes handles 94, 96 for grasping by a user during operation (see FIG. 1). In an embodiment, the pull-in tool 10 includes a trigger or other actuation device for engaging and disengaging the cylinder 84 (not shown in the Figures).

Referring to FIGS. 1 through 2B, In an embodiment, the pull-in tool 10 is adapted to engage a fastener 100 for securing together a plurality of workpieces 102, 104. In an embodiment, the workpieces 102, 104 are composite structures. In an embodiment, the workpieces 102, 104 are metallic structures. In an embodiment, the workpiece 104 includes a projection 106 defining a limited access area 108. In an embodiment, the fastener 100 includes a pin member 110 and a sleeve member 112, which are fitted within corresponding holes 114, 116 of the workpieces 102, 104 to form an interference fit. In an embodiment, the pin member 110 includes an elongated shank portion 118 which terminates at one end in a head 120. In an embodiment, the shank portion 118 includes a substantially smooth portion 122, a threaded portion 124, and a frangible portion 126 extending from the threaded portion 124 by a breakneck groove 128. In an embodiment, the frangible portion 126 includes a pull portion 130 having circumferential pull grooves 132. In an embodiment, the fastener 110 may comprise of any one of the fasteners disclosed in U.S. Pat. No. 7,695,226 to March et al. entitled "High Performance Sleeved Interference Fasteners for Composite Applications," issued Apr. 13, 2010, which is incorporated by reference herein it is entirety. In an embodiment, the pull-in tool 10 can be used to install interference fasteners without associated sleeve members.

Figure 3A:
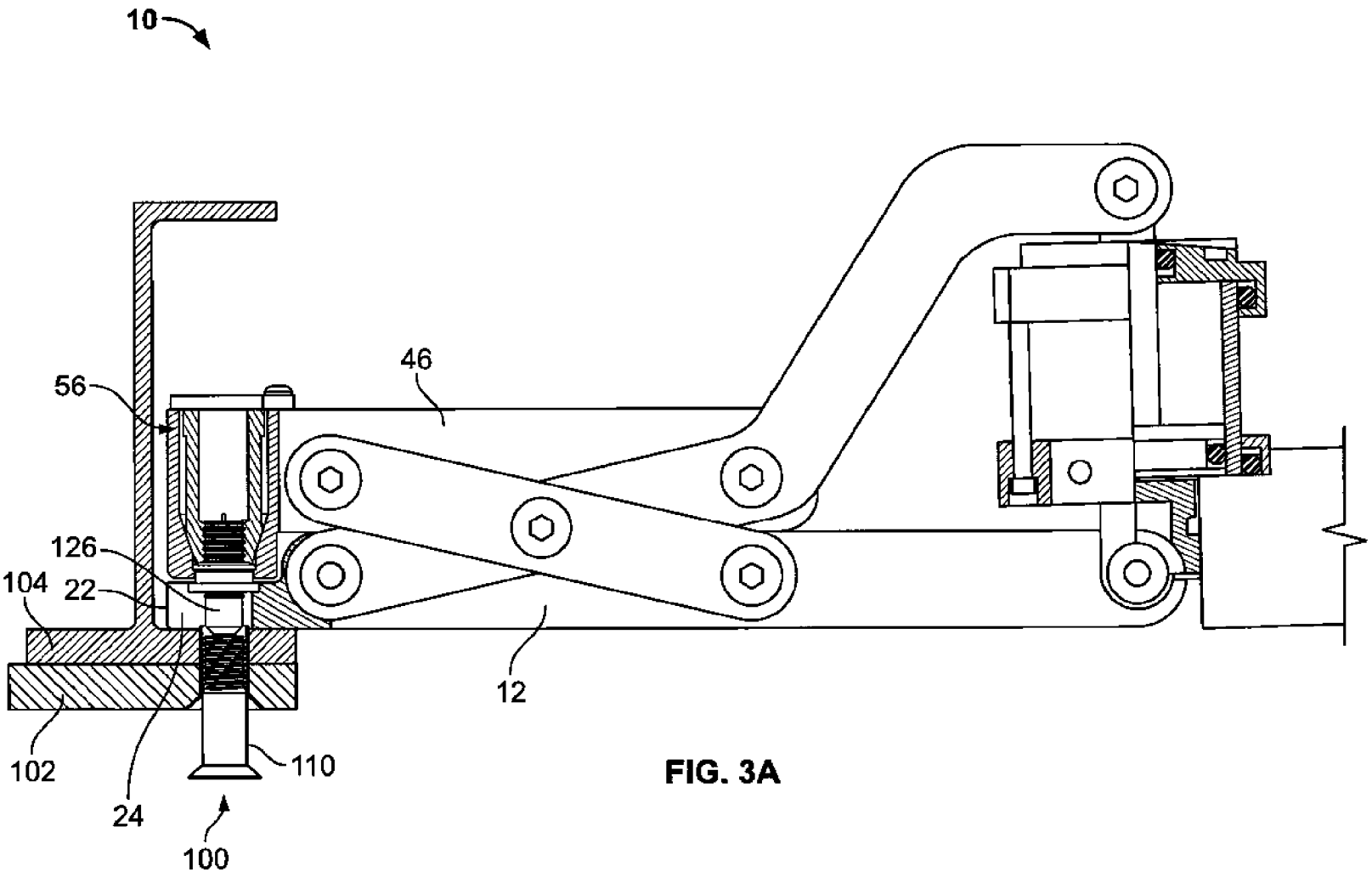
FIG. 3A is a side elevational view of the tool illustrated by FIG. 2A, shown in a "start" position.
Figure 3B:
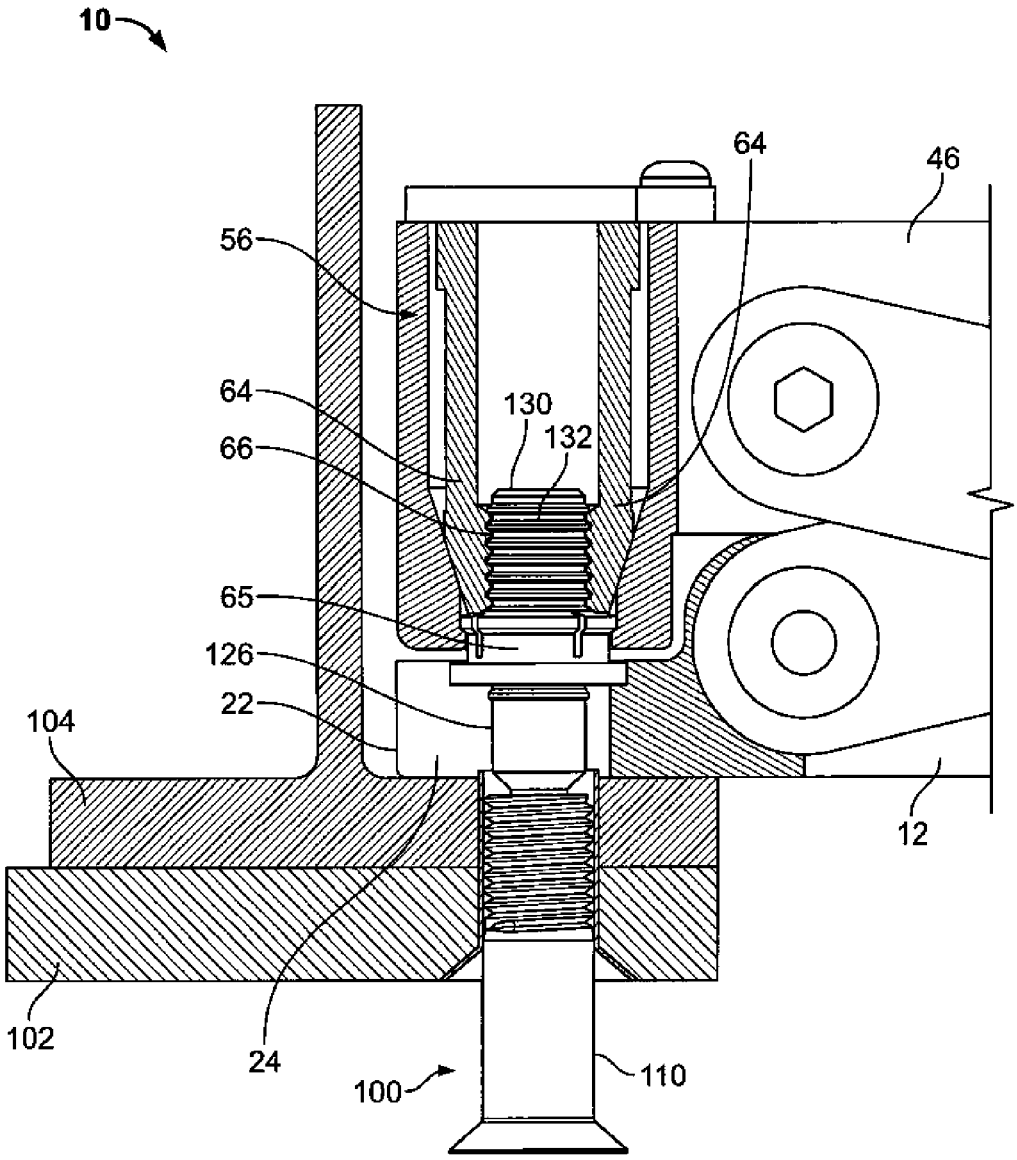
FIG. 3B is a close-up side elevational view of a portion of the tool shown in FIG. 3A.

Referring to FIGS. 1 through 2B, in an embodiment, the sleeve member 112 is inserted within the holes 114, 116 of the workpieces 102, 104, and the pin member 110 is partially inserted within the sleeve member 112, and is sized and shaped to be held in place by an interference fit. In an embodiment, an outer diameter of the pin member 110 is greater than the inner diameter of the sleeve member 112 to facilitate such an interference fit. In an embodiment, the pull-in tool 10 is shown in its initial engaged position, such that the head 22 of the lower jaw 12 engages the frangible portion 126 of the pin member 110 to facilitate aligning the pull-in tool 10 with the fastener 100. In an embodiment, the pull-in tool 10, especially the upper jaw 46 thereof, is configured and sized and shaped to occupy and operate within the limited access area 108 formed by the projection 106. Referring to FIGS. 3A and 3B, the pull-in tool 10 is shown in its start position, such that the opening 24 of the head 22 of the lower jaw 12 fully engages the frangible portion 126 of the pin member 110 and contacts one side of the workpiece 104. In an embodiment, the head 56 of the upper jaw 46 engages the fastener 100, such that the internal threads 66 of the gripping jaws 64 engage the pull grooves 132 of the pull portion 130.

Figure 4:
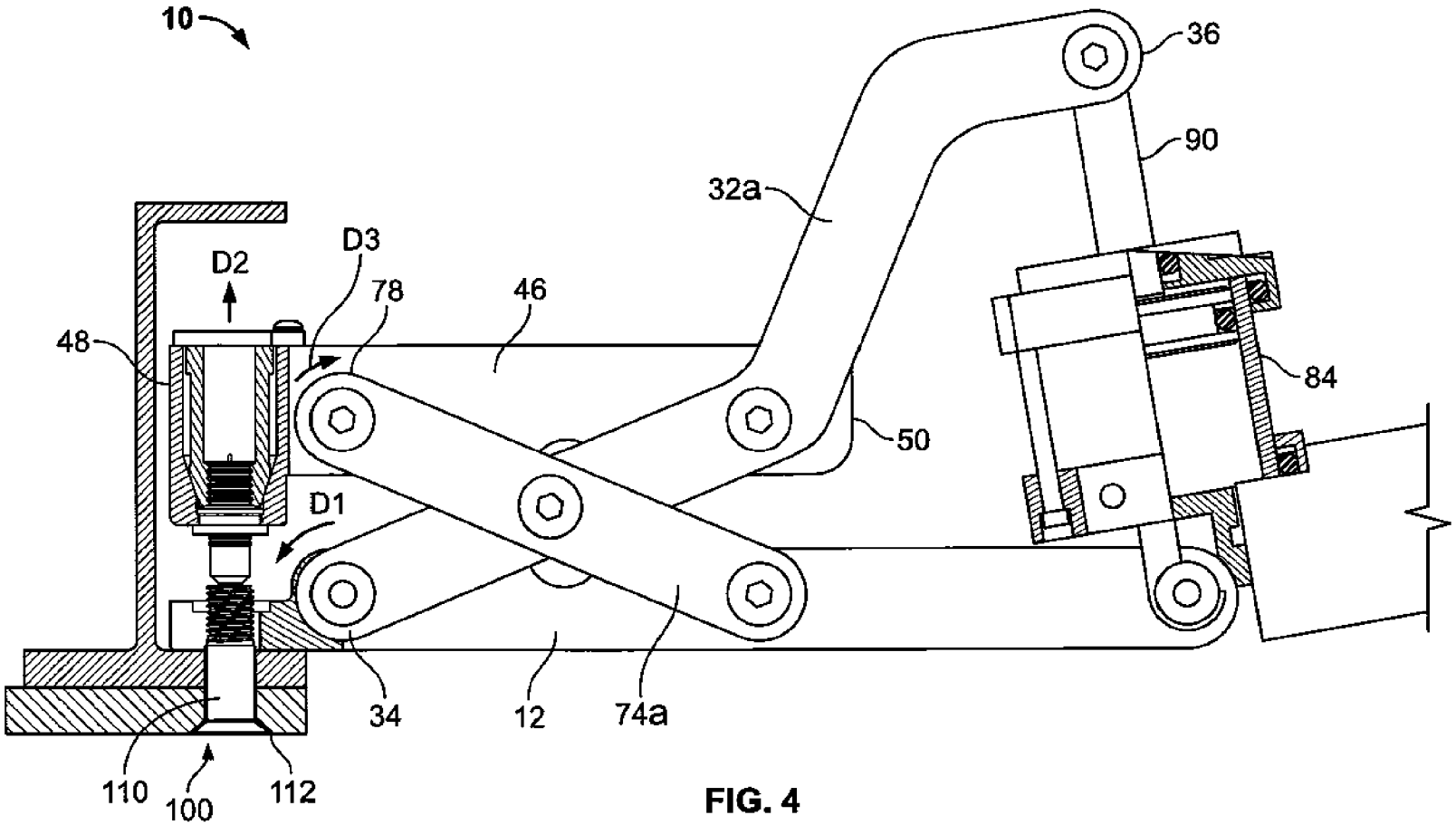
FIG. 4 is a side elevational view of the illustrated by FIG. 3A, shown in a "finished" position.
Figure 5:
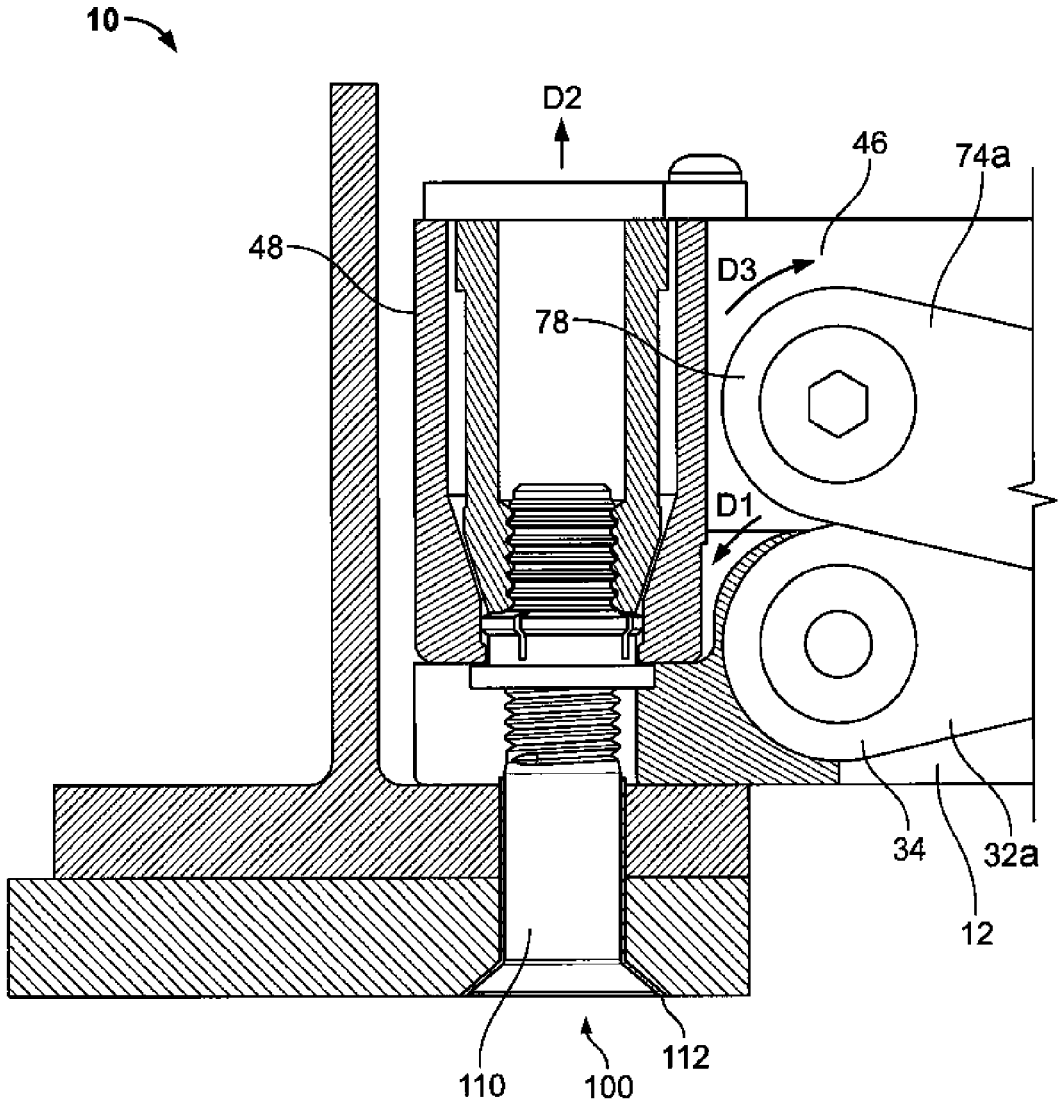
FIG. 5 is a close-up side elevational view of a portion of the tool illustrated by FIG. 4, shown in a "jaws-opened" position.

Referring to FIGS. 4 and 5, in an embodiment, the pull-in tool 10 is shown in its "finished" position, such that the cylinder 84 is actuated and the piston rod 90 extends outwardly therefrom (see FIG. 4), forcing the second ends 36 of the links 32*a*, 32*b* to rotate about their first ends 34 in a direction D1. In turn, the rotation of the links 32*a*, 32*b* urges the upper jaw 46 to ascend in a direction D2 away from the lower jaw 12. Simultaneously, the links 74*a*, 74*b* rotate about their second ends 78 in a direction D3 to facilitate the ascension of the first and second ends 48, 50 of the upper jaw 46 at a parallel and consistent level. In an embodiment, the movement of the upper jaw 46 applies an axial force on and pulls the pin member 110 into the sleeve member 112 until the pin member 110 is in its fully installed position, in which an interference fit is formed (see FIG. 5). In an embodiment, the links 32*a*, 32*b* and the links 74*a*, 74*b* permits application of force over a distance, or offset, from the cylinder 84 as the load source. Thus, in an embodiment, the links 32*a*, 32*b* and the links 74*a*, 74*b* apply the load with minimal or negligible prying to the fastener 100 during the pull-in operation. In an embodiment, the pull-in force of the pull-in tool 10 is a function of the dimensional details thereof. In an embodiment, as an example, the pull-in force for the pull-in tool 10 for #10 diameter (5/16") fasteners is about 3,000 lbf. In other embodiments, the pull-in tool 10 can be adapted to provide different pull-in forces and can be used for fasteners having different sizes and shapes.

Figure 6:
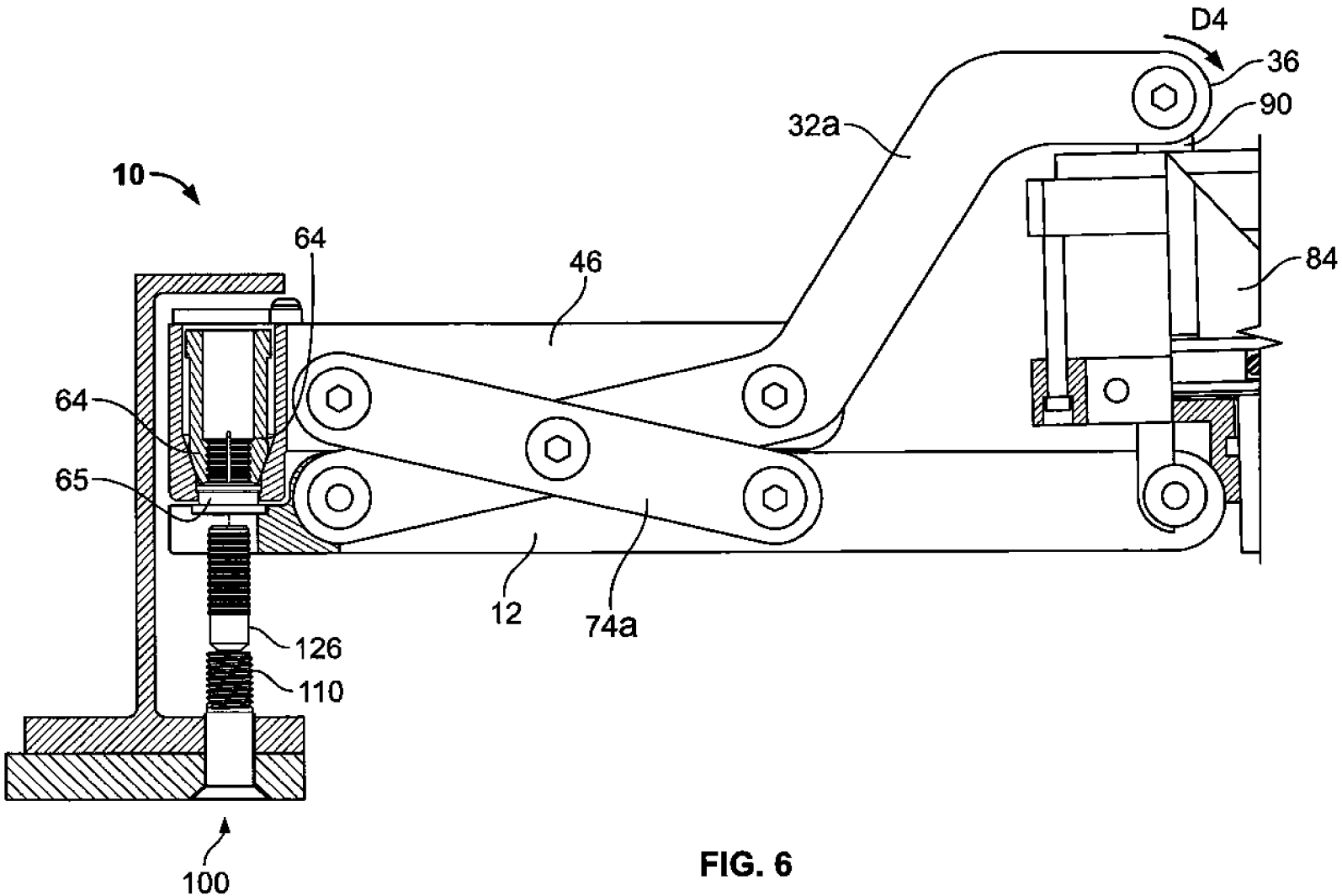
FIG. 6 is side elevational view of the tool illustrated by FIG. 4, shown in a disengaged position.
Figure 7:
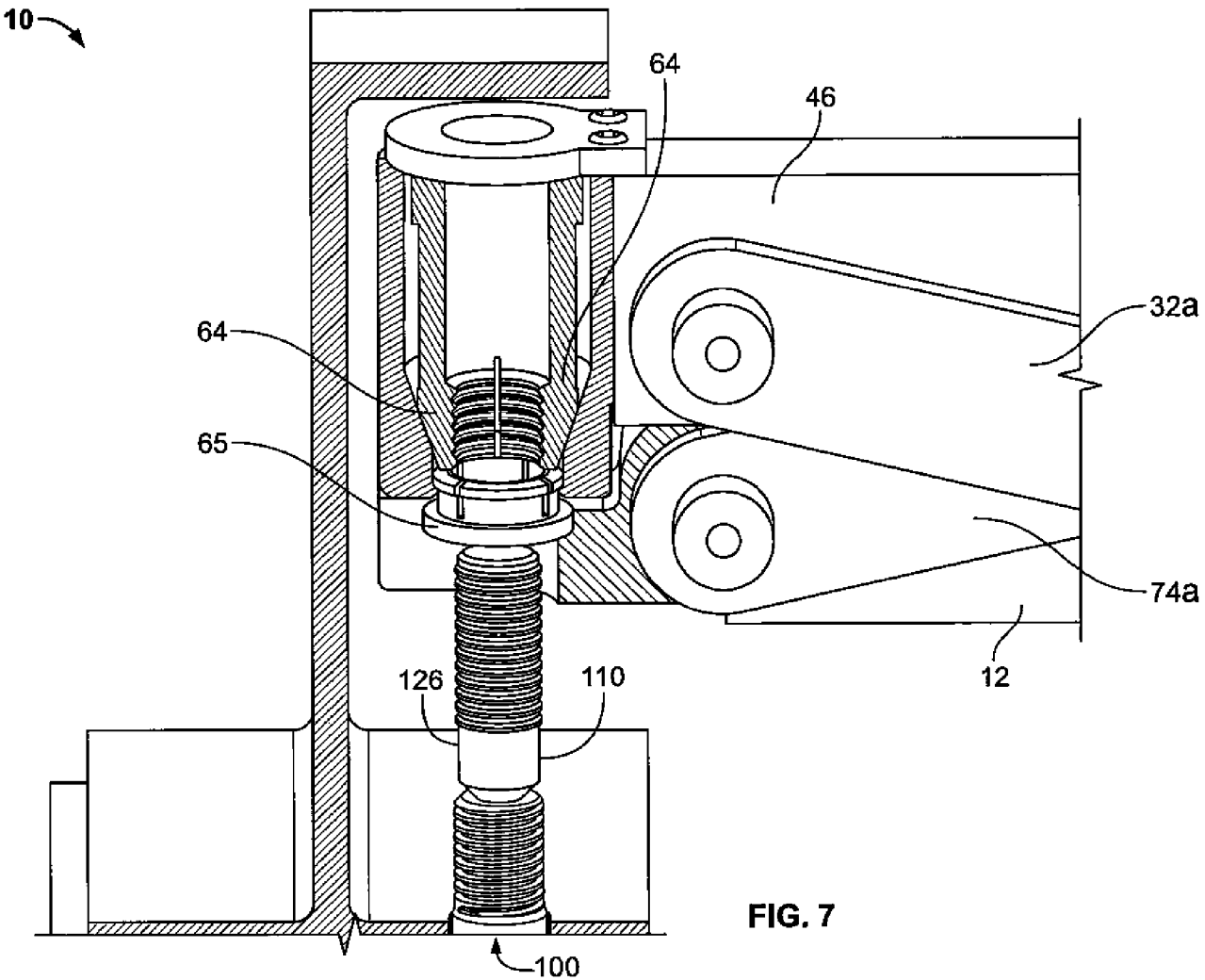
FIG. 7 is a close-up side perspective view of a portion of the fastener installation tool shown in FIG. 6.

Referring to FIGS. 6 and 7, the pull-in tool 10 is shown in its disengaged position, such that the gripping jaws 64 of the upper jaw 46 retract and are released from the frangible portion 126 of the pin member 110. In an embodiment, the piston rod 90 retracts into the cylinder 84 and pulls the second ends 36 of the links 32*a*, 32*b* back in a direction D4. In turn, the upper jaw 46 descends back towards the lower jaw 12 and the links 74*a*, 74*b* retract.

FIGS. 8 through 12 show an embodiment of a fastener swage tool 210. In an embodiment, the fastener swage tool 210. Elements illustrated in FIGS. 8 through 12 which correspond, either identically or substantially, to the elements described above with respect to the embodiment shown in FIGS. 1 through 7 have been designated by corresponding reference numerals increased by two hundred, respectively. Unless otherwise stated, the embodiment of FIGS. 8 through 12 is constructed and assembled in the same manner as the embodiment of FIGS. 1 through 7.

Figure 8:
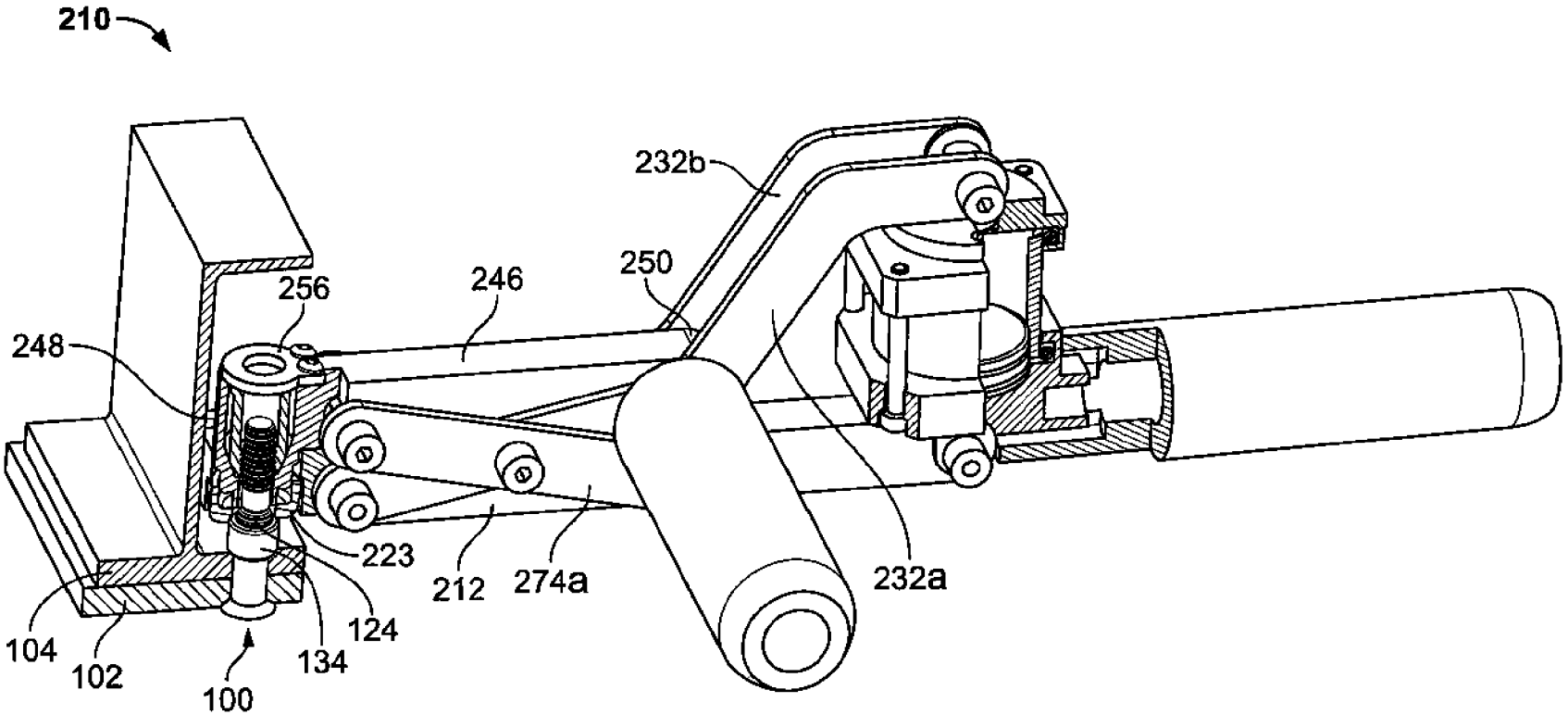
FIG. 8 is a top perspective view of an embodiment of a swaging fastener installation tool shown in a "start swage" position, portions of the tool being shown in cross-section.
Figure 9:
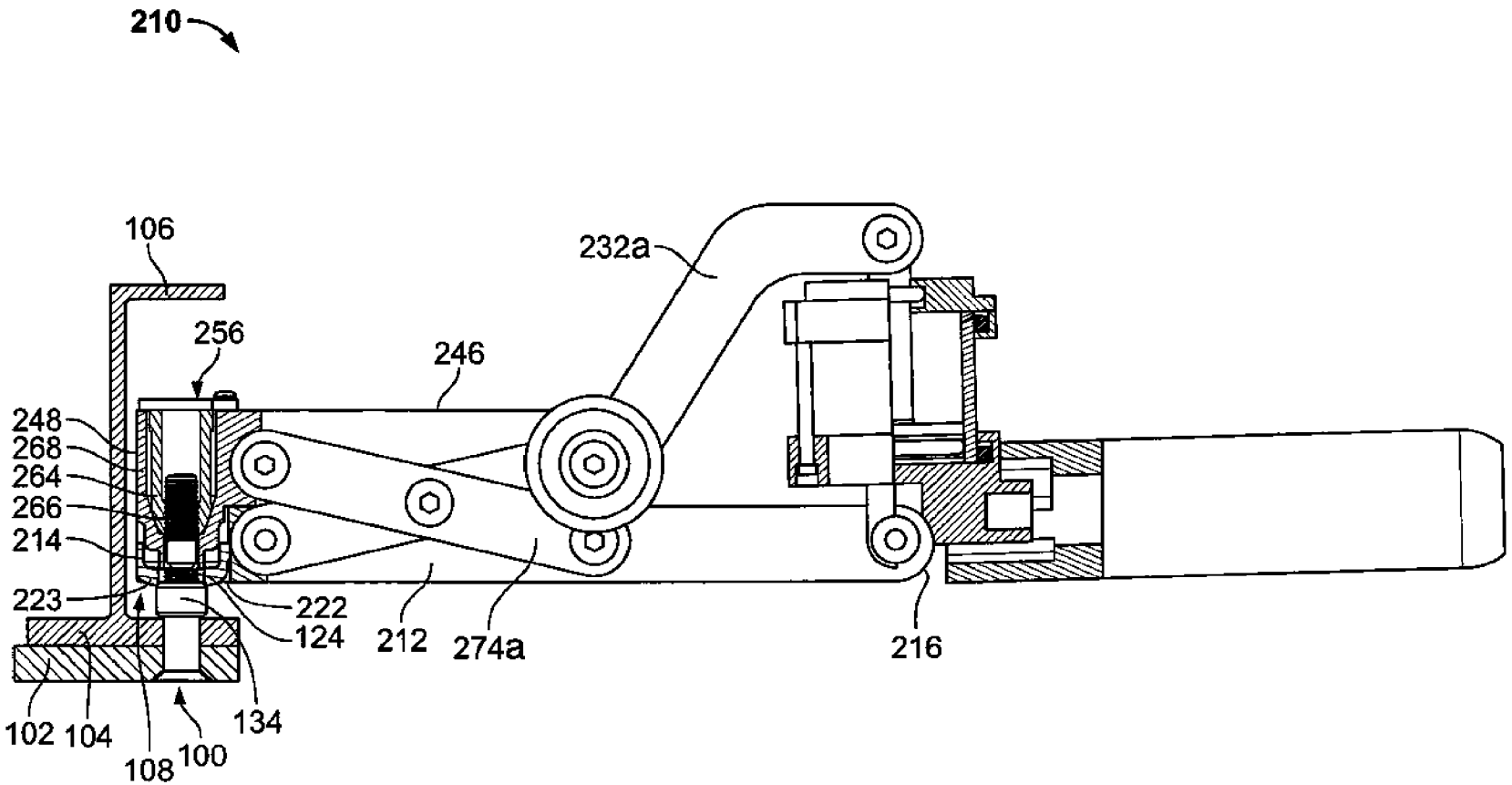
FIG. 9 is a side elevational view of the fastener installation tool shown in FIG. 8.
Figure 10:
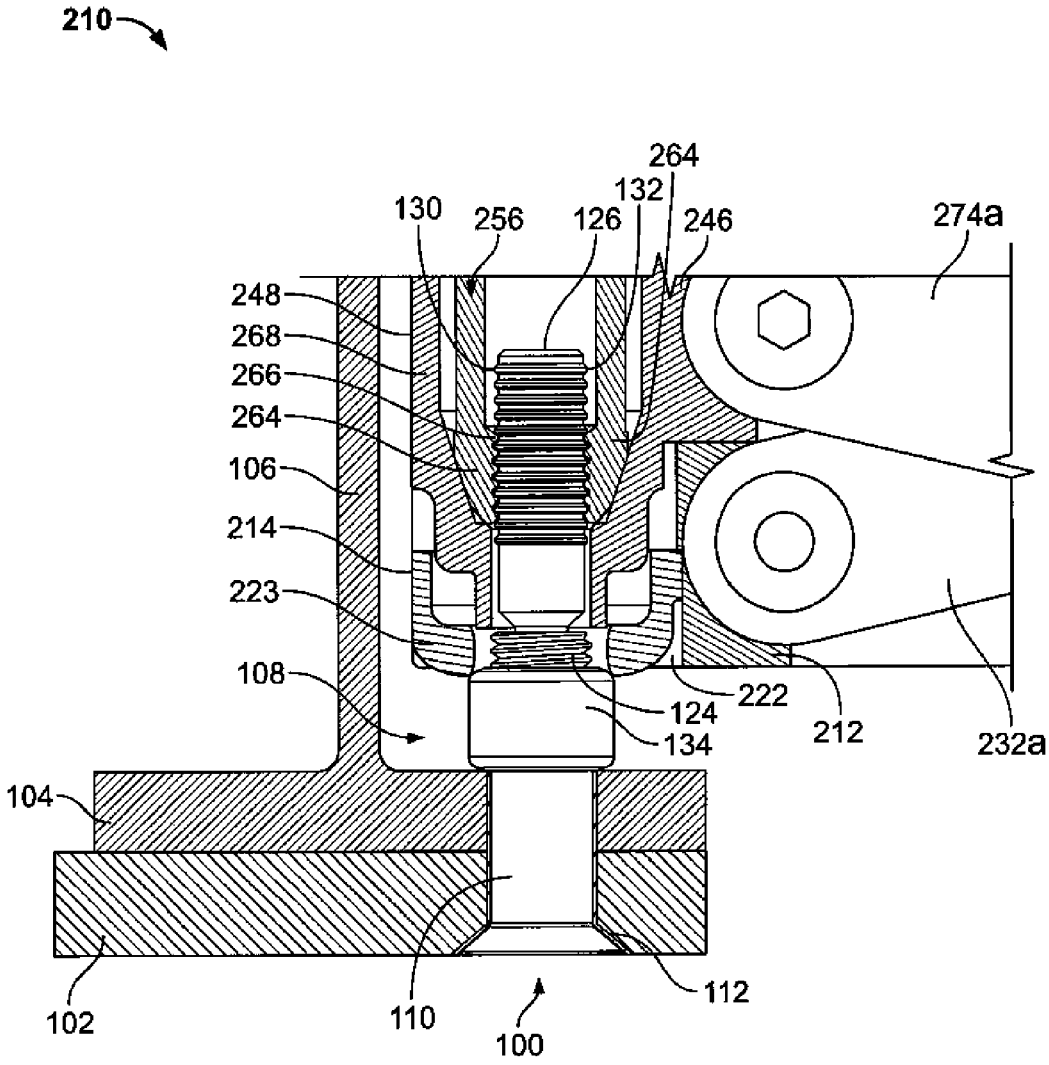
FIG. 10 is a close-up side elevational view of a portion of the fastener installation tool shown in FIG. 9.

Referring to FIGS. 8 through 10, in an embodiment, the swage tool 210 includes an elongated lower jaw 212 having a first end 214 and a second end 216 opposite the first end 214, and a head 222 located at the first end 214. In an embodiment, the head 222 includes an anvil member 223, whose purpose shall be described hereinafter.

In an embodiment, the swage tool 210 includes an upper jaw 246 having a first end 248 and a second end 250 opposite the first end 248 and a head 256 located at the second end 250. In an embodiment, the head 256 includes a set of gripping jaws 264 with internal threads 266. In an embodiment, the gripping jaws 264 are located in a tubular collet 268. In an embodiment, the fastener 100 (the pin member 110 and the sleeve member 112 of which having been installed previously within the workpieces 102, 104 by the pull-in tool 10), receives a collar 134 to be swaged onto the threaded portion 124 of the pin member 110. In an embodiment, the collar 134 may comprise any one of the collars disclosed in U.S. Pat. No. 7,695,226 referenced above.

Referring to FIGS. 8 through 10, in an embodiment, the swage tool 210 is shown in its initial "start swage" position, such that the head 222 of the lower jaw 212 engages the frangible portion 126 of the pin member 110 to facilitate aligning the swage tool 210 with the fastener 100. In an embodiment, the head 256 of the upper jaw 246 engages the fastener 100, such that the internal threads 266 of the gripping jaws 264 engage the pull grooves 132 of the pull portion 130. In an embodiment, the swage tool 210, especially the upper jaw 246 thereof, is configured, sized and shaped to occupy and operate within the limited access area 108 formed by the projection 106.

Figure 11A:
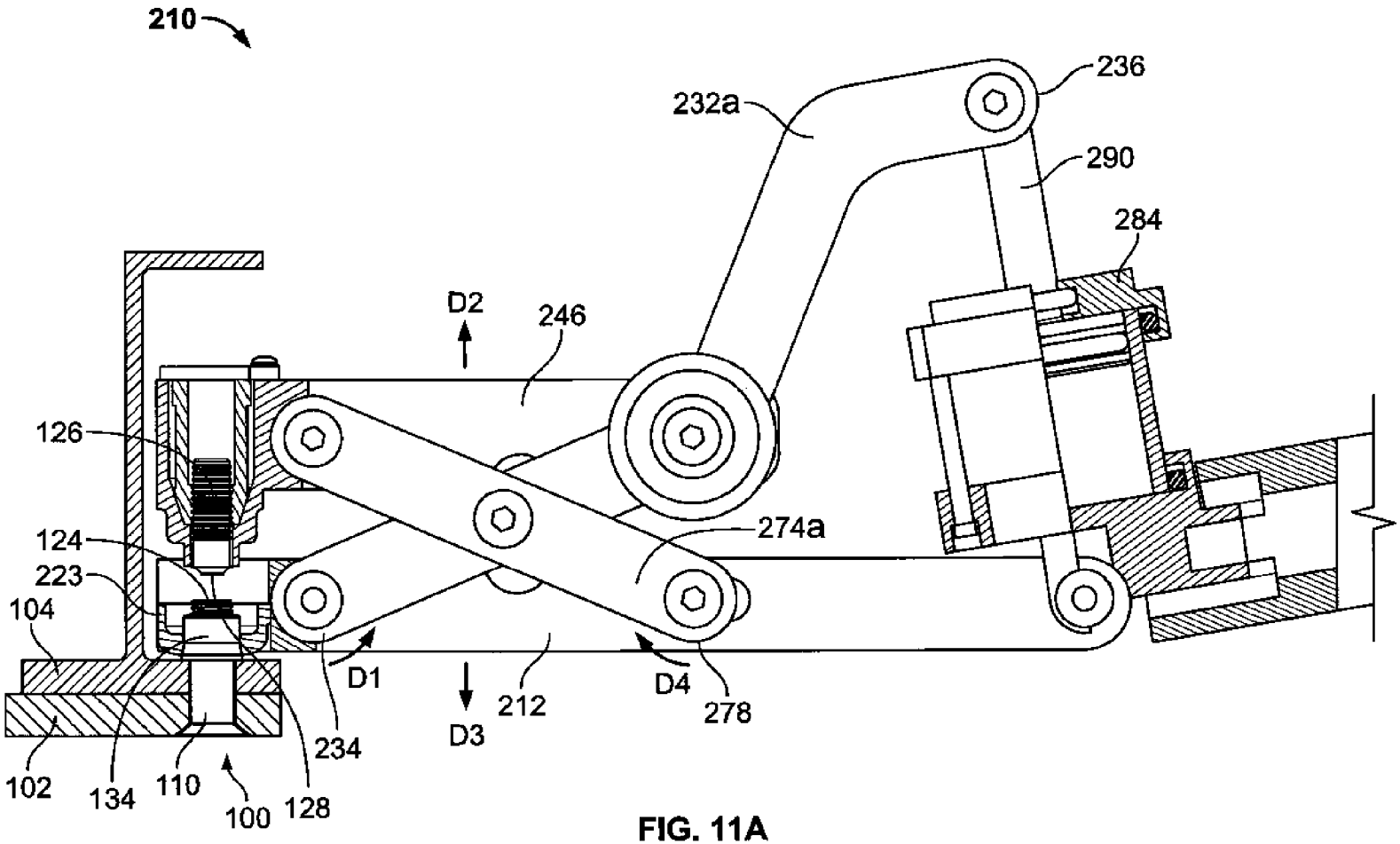
FIG. 11A is side elevational view of the fastener installation tool illustrated in FIG. 9, shown in a "finished swage" position.
Figure 11B:
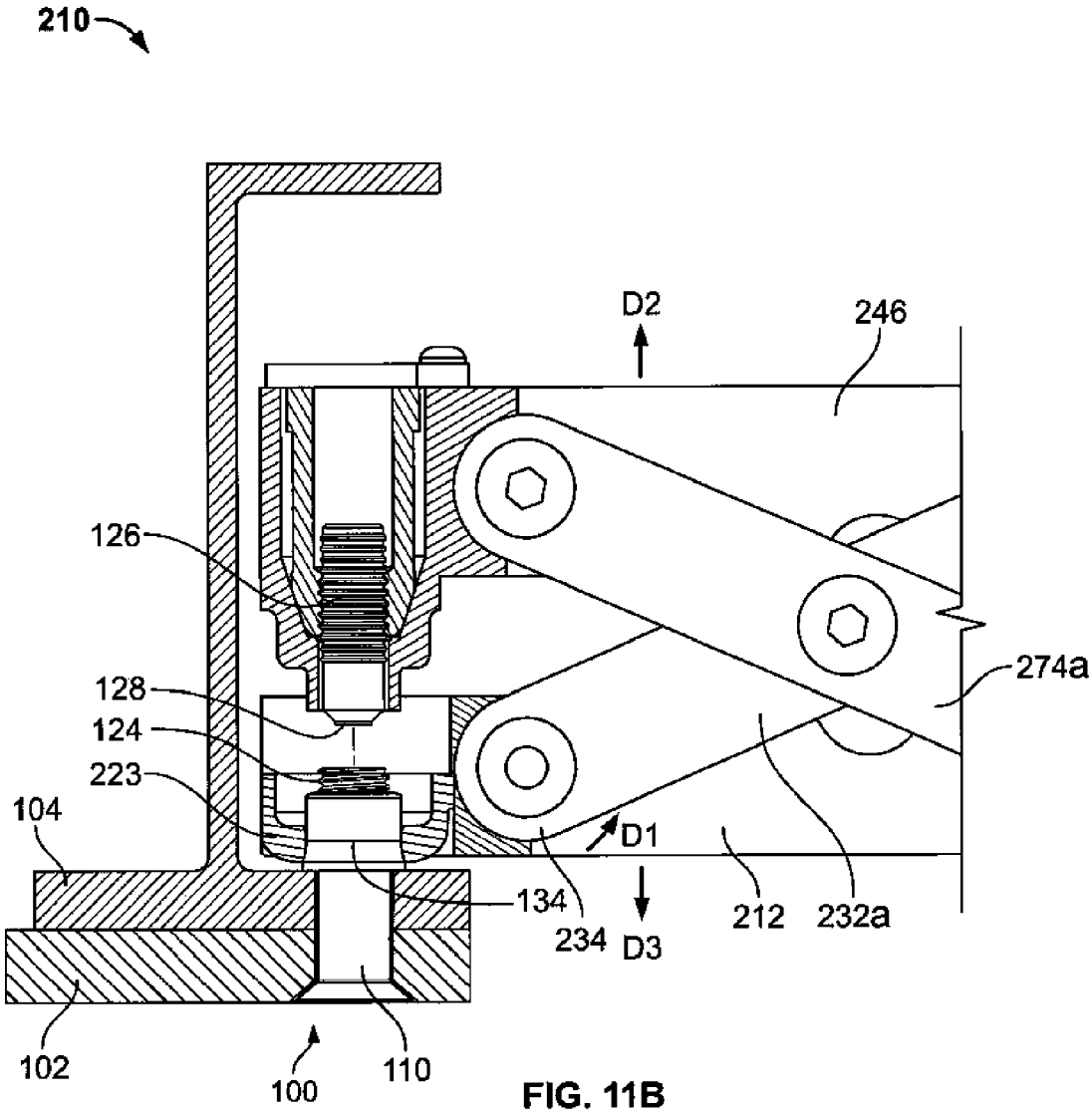
FIG. 11B is a close-up side elevational view of a portion of the fastener installation tool shown in FIG. 11A.

Referring to FIGS. 11A and 11B, in an embodiment, the tool 210 is shown in its "finished swage" position, such that the cylinder 284 is engaged and the piston rod 290 extends outwardly therefrom (see FIG. 11A), forcing the second ends 236 of the links 232*a*, 232*b* to rotate about their first ends 234 in a direction D1. In turn, the rotation of the links 232*a*, 232*b* urges the upper jaw 246 to ascend in a direction D2 while the lower jaw 212 is urged in a direction D3 towards the workpiece 104. Simultaneously, the links 274*a*, 274*b* rotate about their second ends 278 in a direction D4 to facilitate the ascension of the upper jaw 246 and the descension of the lower jaw 212 at a parallel and consistent level. In an embodiment, the movement of the lower jaw 212 enables the anvil member 223 to swage the collar 134 onto the threaded portion 124 of the pin member 110. Afterwards, in an embodiment, the upper jaw 246 applies an axial force on and pulls the frangible portion 126 of the pin member 110 until it shears at the breakneck groove 128. In an embodiment, the links 232*a*, 232*b* and the links 274*a*, 274*b* permits application of force over a distance, or offset, from the cylinder 284 as the load source. Thus, in an embodiment, the links 232*a*, 232*b* and the links 274*a*, 274*b* apply the load with minimal or negligible prying to the fastener 100 during the swaging operation. In an embodiment, the swaging force of the swage tool 210 is a function of the dimensional details thereof. In an embodiment, as an example, the swaging force for the swage tool 210 for swaging a #10 diameter collar is about 5,500 lbf. In other embodiments, the swage tool 210 can be adapted to provide different pull-in forces and can be used for fasteners having different sizes and shapes.

Figure 12:
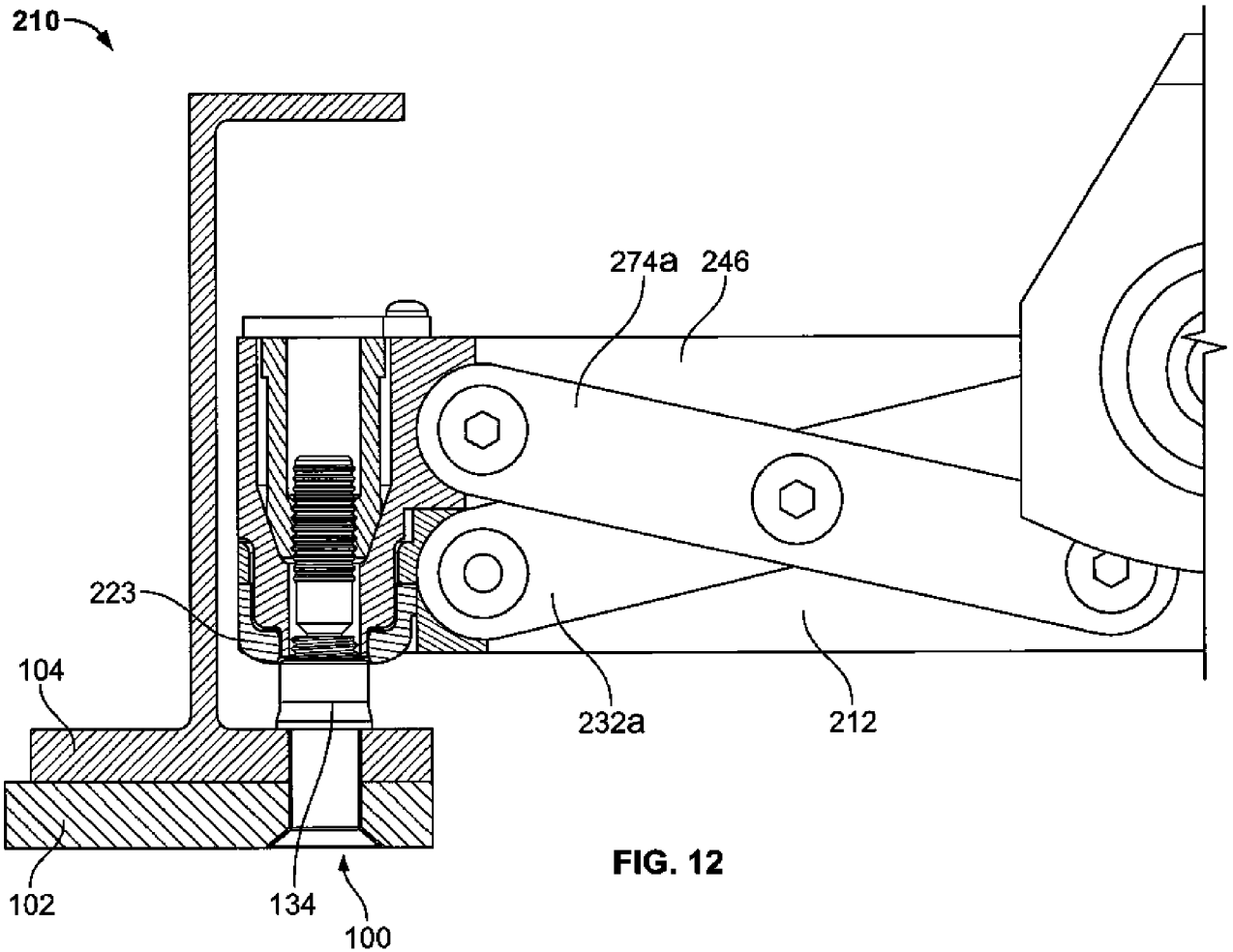
FIG. 12 is a close-up side elevational view of a portion of the fastener installation tool illustrated by FIG. 11A, shown in a "strip anvil" mode.

Referring to FIG. 12, in an embodiment, the swage tool 210 is shown in its disengaged position, such that the piston rod 290 retracts into the cylinder 284 (not shown in FIG. 12) and retracts the second ends 236 of the links 232*a*, 232*b*. In turn, the lower jaw 212 ascends towards the upper jaw 246 and the links 274*a*, 274*b* retract, enabling the anvil member 223 to disengage the collar 134. The swage tool 210 is then pulled away from the fastener 100, which is fully installed within the workpieces 102, 104.

It will be understood that the tools 10, 210 and their uses described herein are merely exemplary and that a person skilled in the art may make many variations and modifications without departing from the full spirit and the scope of the embodiments described herein. For instance, the hydraulic cylinder 84 can be replaced with any other suitable actuating means known in the art for engaging the links 32*a*, 32*b* and 232*a*, 232*b*. In an embodiment, one alternative to swaging the collar 134 onto the pin member 110 is to thread a nut or threaded collar onto the threaded portion 124 of the pin member 110. In this regard, the frangible portion 126 can be broken off at the breakneck groove 128 using the pull-in tool 10 and then the nut or threaded collar could be installed and torqued to the desired clamp load. All such variations and modifications are intended to be included within the scope of the invention as defined in the appended claims.

What is claimed is:

1. A fastener installation tool, comprising:

an upper jaw having a first end, a second end opposite the first end, a first side extending between the first and second ends, a second side opposite the first side and extending between the first and second ends, and a head located at the first end and adapted to engage a fastener for securing a plurality of workpieces to one another;

a lower jaw having a first end, a second end opposite the first end of the lower jaw, a first side extending between the first and second ends of the lower jaw, a second side opposite the first side of the lower jaw and extending between the first and second ends of the lower jaw, and a head located at the first end of the lower jaw;

a first pair of links, each of which includes a first end, a second end opposite the first end thereof, and an intermediate point located between the first and second ends thereof, the first end of one of the first pair of links being fastened to the first end of the lower jaw on the first side thereof, and the intermediate point of the one of the first pair of links being fastened to the second end of the upper jaw on the first side thereof, the first end of the other of the first pair of links being fastened to the first end of the lower jaw on the second side thereof, and the intermediate point of the other of the first pair of links being fastened to the second end of the upper jaw on the second side thereof;

a second pair of links, each of which includes a first end and a second end opposite the first end thereof, the first end of one of the second pair of links being fastened to the first end of the upper jaw on the first side thereof and the second end of the one of the second pair of links being fastened to the lower jaw on the first side thereof, the first end of the other of the second pair of links being fastened to the first end of the upper jaw on the second side thereof, and the second end of the other of the second pair of links being fastened to the lower jaw on the second side thereof; and actuating means, attached to the second end of the lower jaw and the second ends of the first pair of links, for actuating the fastener installation tool between a disengaged position, in which the first pair of links and the second pair of links are each in a retracted position and the upper jaw and the lower jaw are juxtaposed with one another, and an engaged position, in which the first pair of links and the second pair of links are each in an extended position and the upper jaw and the lower jaw are spaced apart from one another, the head of the upper jaw being adapted to install the fastener to the plurality of workpieces when the fastener installation tool is in its engaged position.

2. The fastener installation tool of claim 1, wherein the actuating means includes a hydraulic cylinder having a first end, a second end opposite the first end of the cylinder, and a piston rod extending from the second end of the cylinder, the first end of the cylinder being fastened to the second end of the lower jaw, and one end of the piston rod being fastened to the second ends of the first pair of links, the piston rod being movable between a retracted position when the fastener installation tool is in its disengaged position, and an extended position when the fastener installation tool is in its engaged position.

3. The fastener installation tool of claim 2, wherein the head of the upper jaw includes a collet having an interior portion and a set of gripping jaws housed within the interior portion, the set of gripping jaws including a plurality of internal threads, and wherein the fastener includes a pin member having a pull portion with a plurality of pull grooves, the plurality of internal threads of the set of gripping jaws being sized and shaped to engage the pull grooves of the pin member.

4. The fastener installation tool of claim 3, wherein the collet is adapted to provide an axial force on and install the pin member to the plurality of workpieces when the fastener installation tool is actuated from its disengaged position to its engaged position.

5. The fastener installation tool of claim 4, wherein the fastener includes a sleeve member installed within the plurality of workpieces, and the pin member is sized and shaped to be installed within and form an interference fit with the sleeve member.

6. The fastener installation tool of claim 3, wherein the head of the lower jaw includes an anvil member, and wherein the fastener includes a swaging collar, and when the pin member of the fastener includes a threaded portion, the swaging collar being adapted to be swaged onto the threaded portion of the pin member by the anvil member when the fastener installation tool is actuated from its disengaged position to its engaged position.

7. The fastener installation tool of claim 6, wherein the collet of the upper jaw is adapted to shear the pull portion from the pin member when the fastener installation tool is actuated from its disengaged position to its engaged position.

8. The fastener installation tool of claim 3, wherein the head of the upper jaw includes an interior portion and a cap removably attached to the head to allow access to the interior portion.

9. The fastener installation tool of claim 1, wherein each of the first pair of links includes a linear-shaped first portion extending from the first end to the intermediate point, and an angular-shaped second portion extending from the intermediate point to the second end.

10. The fastener installation tool of claim 9, wherein the first and second pairs of links are fastened rotatably to the upper and lower jaws by a plurality of fasteners.

11. The fastener installation tool of claim 10, wherein the first end of the cylinder is fastened rotatably to the lower jaw by a fastener.

12. The fastener installation tool of claim 1, wherein the second end of the one of the second pair of links is fastened to the lower jaw intermediate the first and second ends of the lower jaw, and the second end of the other of the second pair of links is fastened to the lower jaw intermediate the first and second ends of the lower jaw.

13. The fastener installation tool of claim 1, further comprising a safety shroud.

14. The fastener installation tool of claim 1, further comprising at least one handle.

15. The fastener installation tool of claim 1, wherein the plurality of workpieces are composite structures.

16. A fastener installation tool, comprising:

an upper jaw having a first end, a second end opposite the first end, and a head located at the first end and adapted to engage a fastener for securing a plurality of workpieces to one another;

a lower jaw having a first end, a second end opposite the first end of the lower jaw, and a head located at the first end of the lower jaw;

a first pair of spaced-apart links, each of which includes a first end, a second end opposite the first end thereof, and an intermediate point located between the first and second ends thereof, the first end of one of the first pair of links being fastened to the first end of the lower jaw, and the intermediate point of the one of the first pair of links being fastened to the second end of the upper jaw, the first end of the other of the first pair of links being fastened to the first end of the lower jaw, and the intermediate point of the other of the first pair of links being fastened to the second end of the upper jaw;

a second pair of spaced-apart links, each of which includes a first end and a second end opposite the first end thereof, the first end of one of the second pair of links being fastened to the first end of the upper jaw and the second end of the one of the second pair of links being fastened to the lower jaw, the first end of the other of the second pair of links being fastened to the first end of the upper jaw, and the second end of the other of the second pair of links being fastened to the lower jaw; and actuating means, attached to the second end of the lower jaw and the second ends of the first pair of links, for actuating the fastener installation tool between a disengaged position, in which the first pair of links and the second pair of links are each in a retracted position and the upper jaw and the lower jaw are juxtaposed with one another, and an engaged position, in which the first pair of links and the second pair of links are each in an extended position and the upper jaw and the lower jaw are spaced apart from one another, the head of the upper jaw being adapted to install the fastener to the plurality of workpieces when the fastener installation tool is in its engaged position.

17. The fastener installation tool of claim 16, wherein the actuating means includes a hydraulic cylinder having a first end, a second end opposite the first end of the cylinder, and a piston rod extending from the second end of the cylinder, the first end of the cylinder being fastened to the second end of the lower jaw, and one end of the piston rod being fastened to the second ends of the first pair of links, the piston rod being movable between a retracted position when the fastener installation tool is in its disengaged position, and an extended position when the fastener installation tool is in its engaged position.

18. A fastener installation tool, comprising:

an upper jaw having a first end, a second end opposite the first end, and a head located at the first end and adapted to engage a fastener for securing a plurality of workpieces to one another;

a lower jaw having a first end, a second end opposite the first end of the lower jaw, and a head located at the first end of the lower jaw;

at least one first link including a first end, a second end opposite the first end of the at least one first link, and an intermediate point located between the first and second ends of the at least one first link, the first end of the at least one first link being fastened to the first end of the lower jaw, and the intermediate point of the at least one first link being fastened to the second end of the upper jaw;

at least one second link including a first end and a second end opposite the first end of the at least one second link, the first end of the at least one second link being fastened to the first end of the upper jaw and the second end of the at least one second link being fastened to the lower jaw; and actuating means, attached to the second end of the lower jaw and the second end of the at least one first link, for actuating the fastener installation tool between a disengaged position, in which the at least one first link and the at least one second link are each in a retracted position and the upper jaw and the lower jaw are juxtaposed with one another, and an engaged position, in which the at least one first link and the at least one second link are each in an extended position and the upper jaw and the lower jaw are spaced apart from one another, the head of the upper jaw being adapted to install the fastener to the plurality of workpieces when the fastener installation tool is in its engaged position.

19. The fastener installation tool of claim 18, wherein the actuating means includes a hydraulic cylinder having a first end, a second end opposite the first end of the cylinder, and a piston rod extending from the second end of the cylinder, the first end of the cylinder being fastened to the second end of the lower jaw, and one end of the piston rod being fastened to the second ends of the at least one first link and the at least one second link, the piston rod being movable between a retracted position when the fastener installation tool is in its disengaged position, and an extended position when the fastener installation tool is in its engaged position.

* * * * *